US011280094B2

(12) United States Patent
Alexander

(10) Patent No.: US 11,280,094 B2
(45) Date of Patent: Mar. 22, 2022

(54) STAIR CAGE

(71) Applicant: Scott Alexander, Chicago, IL (US)

(72) Inventor: Scott Alexander, Chicago, IL (US)

(73) Assignee: ALEXANDER IDEAS INC., Chicago, IL (US)

( * ) Notice: Subject to any disclaimer, the term of this patent is extended or adjusted under 35 U.S.C. 154(b) by 0 days.

(21) Appl. No.: 15/621,996

(22) Filed: Jun. 13, 2017

(65) Prior Publication Data

US 2021/0404188 A1 Dec. 30, 2021

Related U.S. Application Data

(60) Provisional application No. 62/349,480, filed on Jun. 13, 2016.

(51) Int. Cl.
*E04F 11/18* (2006.01)

(52) U.S. Cl.
CPC ..... *E04F 11/1863* (2013.01); *E04F 11/1808* (2013.01); *E04F 2011/1876* (2013.01)

(58) Field of Classification Search
CPC ... E04F 11/18; E04F 11/1802; E04F 11/1863; E04F 2011/1868; E04F 2011/1876
USPC ..... 52/183, 184
See application file for complete search history.

(56) References Cited

U.S. PATENT DOCUMENTS

| | | | | |
|---|---|---|---|---|
| 5,022,197 | A * | 6/1991 | Aragona | E04F 11/1863 52/183 |
| 7,395,764 | B2 * | 7/2008 | Debrunner | E04F 11/1863 104/89 |
| 2008/0264722 | A1 * | 10/2008 | Yang | E04F 11/1863 182/15 |
| 2010/0031588 | A1 * | 2/2010 | Sangiacomo | B25B 5/006 52/127.1 |
| 2014/0150354 | A1 * | 6/2014 | Danziger | E04F 11/1863 52/29 |
| 2014/0374681 | A1 * | 12/2014 | Brindamour | E04F 11/1863 256/65.16 |
| 2016/0090743 | A1 * | 3/2016 | Medbo | E04F 11/1863 187/202 |

* cited by examiner

*Primary Examiner* — William V Gilbert
(74) *Attorney, Agent, or Firm* — Arc IP Law, PC; Joseph J. Mayo

(57) ABSTRACT

A stair cage is a stair assistance apparatus having a rail attached to the wall on each side of a staircase, and two horizontal rails spaced horizontally apart but joined by cross bars and having wheels rotatably attached to the ends of the cross bars and engaged in tracks within the horizontal rails so that the cross bars are able to move up and down the stairway. A brake system having a brake assembly in the wheels and squeeze brake handles on the cross bars so that the user can control the descent or hold position on the ascent.

12 Claims, 3 Drawing Sheets

STAIR CAGE

CROSS-REFERENCE TO RELATED APPLICATION

The present application is related to and claims priority from prior provisional application Ser. No. 62/349,480, filed Jun. 13, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of stair assistance devices and more specifically relates to a stair cage.

2. Description of the Related Art

Age is nearly always accompanied with the discomforts and the indignities of failing health since advancing age weakens the body and often the mind and puts the elderly on a downhill slope towards the end of life. Memory fails and the bones become frail, brittle, and unreliable, and the skin thins and becomes fragile. The firm stance of the middle years gives way to the tremor of old age and the legs, for many, must be either supplemented with a walker or replaced entirely, in effect, with a wheelchair. For those partially disabled persons in assisted living facilities, nursing homes or long term care units, the time may come when reliance upon the staff is necessary for the essential functions of life: a helping hand to cut one's meat and lift one's fork; a strong armed orderly to help one into or out of bed; a nurse or nurse's aide to help one get into the bathroom and close the door. Old age is a mixed blessing. Anything that can be done to preserve the independence and dignity of the elderly is a blessing and is/will be greatly appreciated by everyone when the inevitability affects them.

By and large, almost everyone would prefer to stay in their own home, and live as independently and self-reliantly as they can, for as long as they can. As we age, we gradually adopt the tools we need to supplant our diminishing powers: walkers or canes to help with mobility, perhaps a magnifier to help with reading, orthopedic socks to help with poor circulation. Ordinary household tools and appliances, showers and tubs, for example may have to be adapted for use by seniors, who become gradually less steady on their feet. One area in which many seniors have difficulty, as do others who cope with mobility problems, is getting up and down stairs.

A walker or cane is of little help here, and many are the seniors who insist on remaining in their homes while refusing to install the stair-climbing chair-lift that they really need. A solution is needed.

Various attempts have been made to solve the above-mentioned problems such as those found in U.S. Pat. No. 5,022,197 to Joel Aragona; U.S. Pat. No. 7,395,764 to Daniel E. Debrunner; and U.S. Pat. No. 2010/0031588 to Ennio Sangiacomo. This art is representative of stair assistance devices. None of the above inventions and patents, taken either singly or in combination, is seen to describe the invention as claimed.

Ideally, a stair assistance devices should provide reliability, low cost, and easy installation, and yet, would operate reliably and be manufactured at a modest expense. Thus, a need exists for a reliable stair cage to avoid the above-mentioned problems.

BRIEF SUMMARY OF THE INVENTION

In view of the foregoing disadvantages inherent in the known stair assistance devices art, the present invention provides a novel stair cage. The general purpose of the present invention, which will be described subsequently in greater detail, is to provide a reliable, low cost, and easy to install stair assistance device.

The stair cage for use on a stairway may comprise two elongated track members adapted to be securely attached to opposing walls of a stair case in proximity to the hand rails. Two elongate cross-bars each have opposing ends and have a track engaging member on each opposing end. Each track engaging member is adapted to selectively slide or grab a respective elongated track member such that each the elongated cross-bar is adapted to be connectable and slidable between and within the two elongated track members.

A center section is pivotable at a proximal end and releasably connected at a distal end to respective end sections of the elongated cross-bar. A brake assembly including at least one brake handle member is located in the center section. A brake line is mechanically connected to and controlled by the brake handle member and is mechanically connected to each track engaging member. When the brake handle member is engaged, the track engaging members and the two elongate cross-bars are stopped within the two elongated track members and when the brake handle member is disengaged, the track engaging members and the two elongate cross-bars are slidable within the two elongated track members and the two connector bars. The two connector bars are respectively connected between the two elongated track members within respective end sections to form a cage adapted to allow a person to stand therein when using the stair cage to move up and down a stairway.

A guard member is connected to the center section of one of the two elongate cross-bars such that when a person is using the stair cage they can lean against the guard member and be held more stably within. The guard member is preferably formed as a padded rigid panel. The track engaging members are formed as wheel members having brake members attached thereto and adapted to selectively resist rotary movement via the respective brake assembly. Each brake assembly and their respective brake members include spring members. The two elongated track members are preferably formed from steel or other rigid material. The two elongate cross-bars are covered with a padding material to make contact by the user more comfortable. The padding material is formed from a protective dense foam material.

Each center section includes a releasable locking member on the distal end to releasably connect with the respective end section of its respective the elongated cross-bar. The two elongate cross-bars are formed having a length of at least 8 feet, or as long or as short as needed for the intended staircase width. The guard member is formed as a foldable panel member. The two elongate cross-bars and the at least two connector bars are formed from a material chosen from a group of materials consisting of metal and rigid plastic.

The present invention holds significant improvements and serves as a stair cage. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, stair cage, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a stair assistance device and more particularly to a stair cage as used to improve the reliability, low cost, and easy installation.

Generally speaking, a stair cage is a stair assistance apparatus having a rail attached to the wall on each side of a staircase, and two horizontal rails spaced horizontally apart but joined by cross bars and having wheels rotatably attached to the ends of the cross bars and engaged in tracks within the horizontal rails so that the cross bars are able to move up and down the stairway. A brake system having a brake assembly in the wheels and squeeze brake handles on the cross bars so that the user can control the descent or hold position on the ascent.

Figure 1:
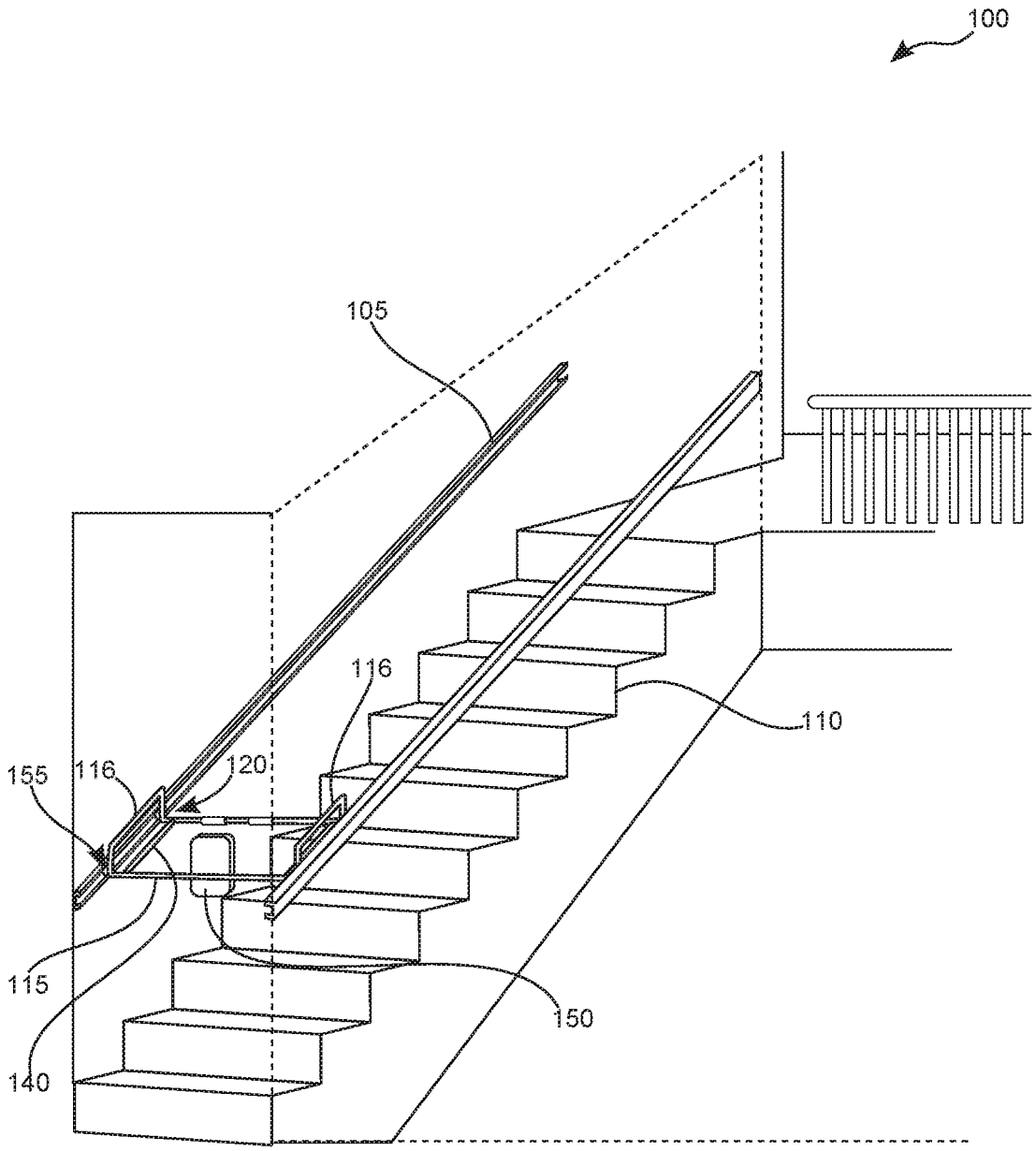
FIG. 1 shows a perspective view illustrating an in-use condition of a stair cage according to an embodiment of the present invention.

In greater detail now, referring to the drawings by numerals of reference there is shown in FIG. 1, a perspective view illustrating an in-use condition of stair cage 100 according to an embodiment of the present invention.

Stair cage 100 for use on a stairway may comprise two elongated track member 105 adapted to be securely attached to opposing walls of stair case 110 in proximity to the hand rails. Two elongate cross-bars 115 each have opposing end 116 and have track engaging member 120 on each opposing end 116. Each track engaging member 120 is adapted to selectively slide or grab a respective elongated track member 105 such that each cross-bar 115 is adapted to be connectable and slidable between and within the two elongated track members 105.

Center section 125 is pivotable at proximal end 126 and releasably connected at distal end 127 to respective end sections 141 of the elongated cross-bar 115. Brake assembly 130 including at least one brake handle member 165 is located in center section 125. Brake line 135 is mechanically connected to and controlled by brake handle member 165 and is mechanically connected to each track engaging member 120.

Figure 2:
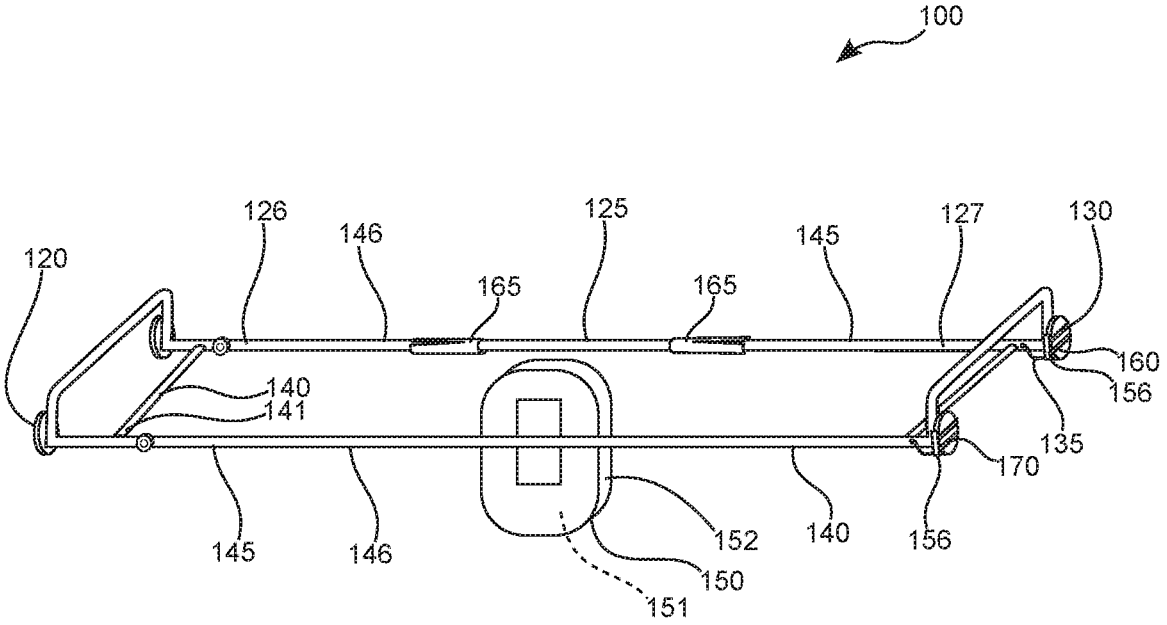
FIG. 2 is a perspective view illustrating a closed position of the stair cage according to an embodiment of the present invention of FIG. 1.

Referring now to FIG. 2, is a perspective view illustrating a closed position of stair cage 100 according to an embodiment of the present invention of FIG. 1.

When brake handle member 165 is engaged, track engaging member 120 and the two elongate cross-bars 115 are stopped within the two elongated track members 105 and when brake handle member 165 is disengaged, track engaging member 120 and the two elongate cross-bars 115 are slidable within the two elongated track members 105 and the two connector bars 140. The two connector bars 140 are respectively connected between the two elongated track members 105 within respective end sections 141 to form stair cage 100 adapted to allow a person to stand therein when using stair cage 100 to move up and down stair case 110.

Guard member 145 is connected to center section 125 of one of the two elongate cross-bar 115 such that when a person is using stair cage 100 they can lean against guard member 145 and be held more stably within. Guard member 145 is preferably formed as padded rigid panel 150. Track engaging members 120 are formed as wheel members 155 having brake assemblies 130 attached thereto and adapted to selectively resist rotary movement via the respective brake assembly 130. Each brake assembly 130 and their respective brake member 170 include spring members 156.

Figure 3:
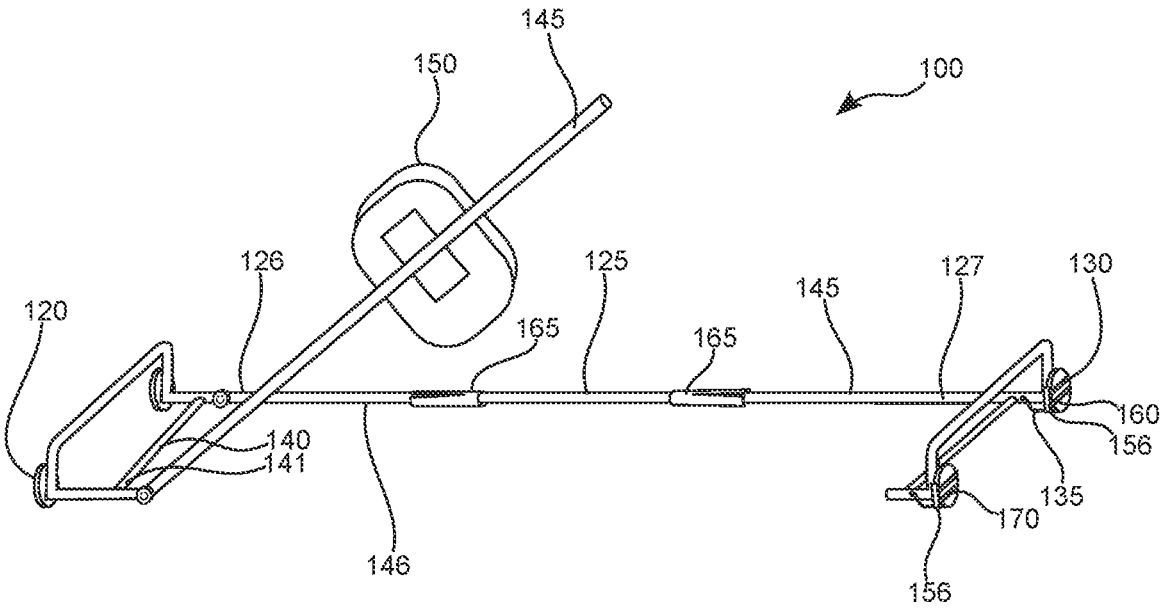
FIG. 3 is a perspective view illustrating an open position of the stair cage according to an embodiment of the present invention of FIG. 1.

Referring now to FIG. 3, is a perspective view illustrating an open position of stair cage 100 according to an embodiment of the present invention of FIG. 1.

The two elongated track members 105 are preferably formed from steel or other rigid material. The two elongate cross-bars 115 are covered with a padding material to make contact by the user more comfortable. The padding material is formed from a protective dense foam material.

Each center section 125 includes releasable locking member 160 on distal end 127 to releasably connect with the respective end section 141 of its respective elongated cross-bar 115. The two elongate cross-bars 115 are formed having a length of at least 8 feet, or as long or as short as needed for the intended staircase 110 width. Guard member 145 is formed as foldable panel member 146. The two elongate cross-bar 115 and the at least two connector bars 140 are formed from a material chosen from a group of materials consisting of metal and rigid plastic.

Stair cage 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A stair cage for use on a stairway, comprising:

two elongated track members;

wherein said two elongated track members are adapted to be securely attached to opposing walls of a stair case in proximity to a position that hand rails are adapted to be positioned;

two elongated cross-bars, each elongated cross-bar of said two elongated cross-bars comprising opposing ends, a track engaging member on each opposing end of said opposing ends forming track engaging members, wherein each said track engaging member is adapted to selectively slide or grab a respective elongated track member of said two elongated track members, such that said each elongated cross-bar is adapted to be connectable and slidable between and within said two elongated track members, a center section, wherein said center section is pivotable at a proximal end thereof and releasably connected at a distal end thereof to respective end sections of said opposing ends of said each elongated cross-bar, a brake assembly comprising at least one brake handle member located in said center section, and a brake line mechanically connected to and controlled by said at least one brake handle member and mechanically connected to each said track engaging member, wherein when said at least one brake handle member is engaged, said track engaging members and thereby said two elongated cross-bars are stopped within said two elongated track members, and wherein when said at least one brake handle member is disengaged, said track engaging members and thereby said two elongated cross-bars are slidable within said two elongated track members; and at least two connector bars, wherein said at least two connector bars are respectively connected between said two elongated track members within said respective end sections thereof, to thereby form a cage adapted to allow a person to stand therein when using said stair cage to move up and down a stairway.

2. The stair cage of claim 1, further comprising a guard member connected to said center section of one of said two elongated cross-bars, such that when a person is using said stair cage, said person is configured to lean against said guard member and be held more stably therein.

3. The stair cage of claim 2, wherein said guard member is formed as a padded rigid panel.

4. The stair cage of claim 2, wherein said guard member is formed as a foldable panel member.

5. The stair cage of claim 1, wherein said track engaging members are formed as wheel members comprising brake members attached thereto and adapted to selectively resist rotary movement thereof respectively via each said brake assembly.

6. The stair cage of claim 5, wherein each said brake assembly and the at least one brake handle member thereof include spring members.

7. The stair cage of claim 1, wherein said two elongated track members are formed from steel.

8. The stair cage of claim 1, wherein said two elongated cross-bars are covered with a padding material.

9. The stair cage of claim 8, wherein said padding material is formed from a protective foam.

10. The stair cage of claim 1, wherein each said center section includes a releasable locking member on said distal end thereof to releasably connect with said respective end sections of said each elongated cross-bar respectively.

11. The stair cage of claim 1, wherein said two elongated cross-bars are formed having a length of at least 8 feet.

12. The stair cage of claim 1, wherein said two elongated cross-bars and said at least two connector bars are formed from a material chosen from a group of materials consisting of metal and rigid plastic.

* * * * *